United States Patent [19]

Hayashi et al.

[11] 4,347,038

[45] Aug. 31, 1982

[54] FLEXIBLE BLADE FAN

[75] Inventors: Masaharu Hayashi, Toyota; Sunzo Tsuchikawa, Ichinomiya, both of Japan

[73] Assignee: Aisin Seiki Kabushiki Kaisha, Kariya, Japan

[21] Appl. No.: 139,749

[22] Filed: Apr. 14, 1980

[30] Foreign Application Priority Data

Apr. 20, 1979 [JP] Japan ..... 54-48819

[51] Int. Cl.[3] ..... F04D 29/38

[52] U.S. Cl. ..... 416/132 A; 416/235; 416/240; 416/DIG. 2

[58] Field of Search ..... 416/132 A, 235, 240 R, 416/241 A, DIG. 2

[56] References Cited

U.S. PATENT DOCUMENTS

| | | | |
|---|---|---|---|
| 3,514,215 | 5/1970 | Williams | 416/235 |
| 3,584,969 | 6/1971 | Aiki et al. | 416/240 R X |
| 3,758,231 | 9/1973 | Barnstead | 416/240 R X |
| 3,915,591 | 10/1975 | Aiki et al. | 416/132 A |

*Primary Examiner*—Leonard E. Smith

*Attorney, Agent, or Firm*—Oblon, Fisher, Spivak, McClelland & Maier

[57] ABSTRACT

A cooling fan for a powered vehicle, adapted for automotive use, and having a hub and a plurality of radial fan blades made integral therewith of synthetic resin material, the fan blade being characterized by provision of a transverse cross section through a limited area of the blade. The transverse cross section is contoured under a condition in which rate of continuous thickness change between a middle point and the leading edge in the transverse cross section is regulated relative to a thickness of the middle point so that the ratio of the thickness of the leading edge divided by the thickness of the middle point falls in a range of from 1.0 to 1.5 while another rate of continuous thickness change between the middle point and the trailing edge in the transverse cross section is similarly regulated so that another similar ratio falls in a range of from 0.7 to 1.2. The middle point is locationally determined by a distance from the leading edge to the middle point.

2 Claims, 5 Drawing Figures

FLEXIBLE BLADE FAN

BACKGROUND OF THE INVENTION

This invention relates to a multiblade plastic fan for automotive vehicle and more particularly to a transverse cross section of the blades contoured to provide a better life or strength of the blades while maintaining a favorable deformation of blade configuration to an increasing degree with an increase in rotational speed of the fan.

It has been proposed to manufacture the cooling fans from molded plastics on account of prevention of noises occasionally produced by metal blades and simplicity of the deformation of blade configuration mentioned above to thereby substantially reduce the air flow and the horsepower requirement in order to avoid any tendency of over-cooling and hence a reduction of operating efficiency of the engine.

Difficulties were encountered in making the thickness of the fan blade to a suitable value in that, the blade tends to be collapsed during the service life at a portion in the leading side of the blade. This may be attributed to a load caused by resonance of the blade and the driving member of engine to be concentrated particularly to that location.

The employment of the known fluid coupling between the driving member and a hub of the fan has resulted in a favorable damping action of the fluid effective to prevent the fan blade from the aforementioned resonance, being unable however to be effective when there is a situation in which the known fluid chamber of the coupling is emptied of its contents fluid in response to an environmental occasional temperature variation.

Mere selection of thickness of the blade at the aforementioned portion in the leading edge may result in a favorable counter measure for above mentioned conventional drawbacks. On the other hand, however, it will apparently be encountered with another difficulty in ensuring the ability of deforming the blade configuration positively in the desire optimum sense at higher operational speeds of the fan, so as to provide a nearly ideal performance thereof, without overcooling the engine.

SUMMARY OF THE INVENTION

It is therefore the main object of the present invention to provide an efficient fan capable of avoiding substantially the aforementioned conventional drawbacks, yet capable of deforming the blade configuration positively in the optimum sense as the fan increases the rotational speed.

The embodiments of the invention therefore comprise a central hub and a plurality of blades radially extending from the hub, each blade being flexible and integral with the hub, the blade having a contour of a transverse cross section through a region neighboring the foot of the blade, the contour of the blade being provided under a condition in which a rate of continuous thickness change between a middle point and the leading edge in the transverse cross section is regulated relative to a thickness of the middle point so that the ratio of a thickness of the leading edge divided by the thickness of the middle point falls within a range of from 1.0 to 1.5 while another rate of continuous thickness change between the middle point and the trailing edge in the transverse cross section is regulated relative to the thickness of the middle point so that the ratio of a thickness of the trailing edge divided by the thickness of the middle point falls within a range of from 0.7 to 1.2. The middle point is locationally determined by giving a distance from the leading edge.

DESCRIPTION OF THE PREFERRED EMBODIMENTS

Figure 1:
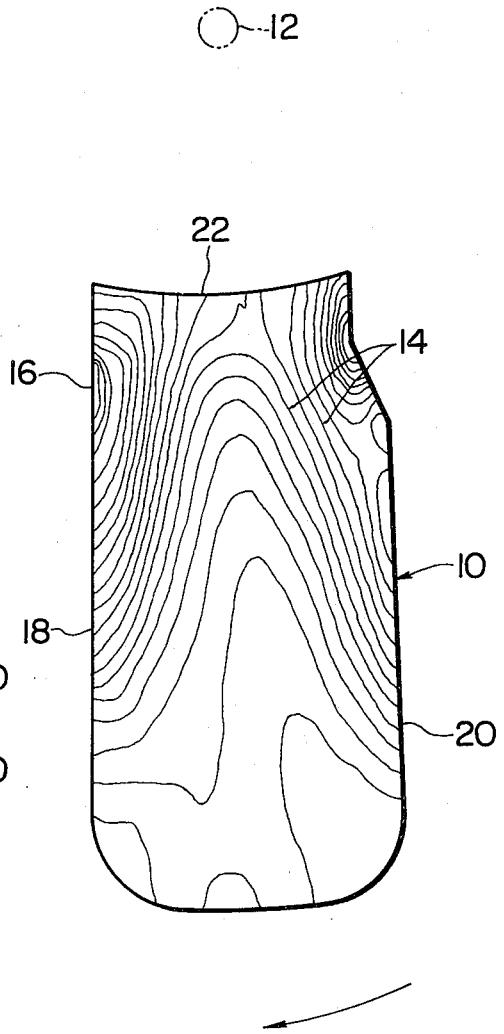
FIG. 1 is a view showing equal stress lines due to resonance of a conventional fan blade, wherein however only a fan blade has been specifically represented and remaining parts have been omitted except the rotational axis shown in phantom.

Referring now to the accompanying drawings, particularly to FIG. 1 showing a regular or conventional fan, the numeral 10 generally denotes one of radial blades of the fan. The blade is made of conventional synthetic resin material having a proper elasticity and made integral with a non-illustrated hub to be connected at the uppermost end of the blade shown by the numeral 22. The hub is rotated when the fan is installed around a rotational axis shown in phantom and denoted by the numeral 12 in the view, by a driving member usually through the known fluid coupling.

When the fan is rotated around the axis 12, the flexible blade of plastic resin material tends to flatten or reduce the blade inclination angle upon the increase in speed due to centrifugal force and the resistance of the air to thereby substantially reduce the air flow and the horsepower requirement. As a result, the vehicle is run more efficiently and with a substantial reduction in fan noise.

When the conventional fan is rotated, the stress diagram in the blade 10 is such that those developing in the entire area of the blade is worked out in FIG. 1 somewhat like isothermal lines in a weather chart. The method is based upon plotting similar or identical load points in the blade which thus outline the shapes of a number of curved lines denoted by the numeral 14. The lines 14 are hereinafter referred to as "equal stress line".

In FIG. 1, the direction of rotation of the fan is hinted at the bottom by the arcuate arrow, so that the left edge 18 of the blade 10 is, in this instance, the leading edge while the right edge 20 is the trailing edge.

It will be seen in FIG. 1, that the equal stress lines 14 are concentrated particularly at a point 16 in the leading edge 18 closer to the uppermost edge 22 of the blade 10. The concentrated point 16 will apparently cause possibility of ruin to decrease length of the service life of the fan.

Figure 2:
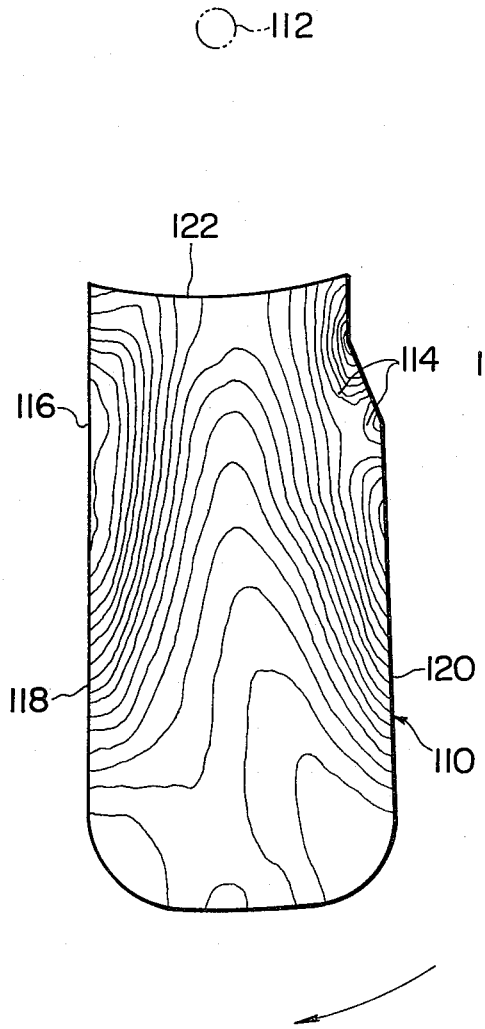
FIG. 2 is a similar view but showing a first embodiment according to the invention.

In FIG. 2 is shown a fan blade 110 produced in accordance with the present invention. The contour of the blade in the front view is strictly in accord with the conventional fan blade 10 in FIG. 1. The thickness of the blade is however calculated as hereinbelow described in detail. The blade 110 is also rotated around the rotational axis 112 shown in phantom in the view in the same rotation direction hinted by the arcuate arrow shown at the bottom of the view. As seen, the equal stress lines 114 are considerably reduced around the point 116 in the blade 110 when compared with the locationally corresponding point in FIG. 1.

Figure 3:
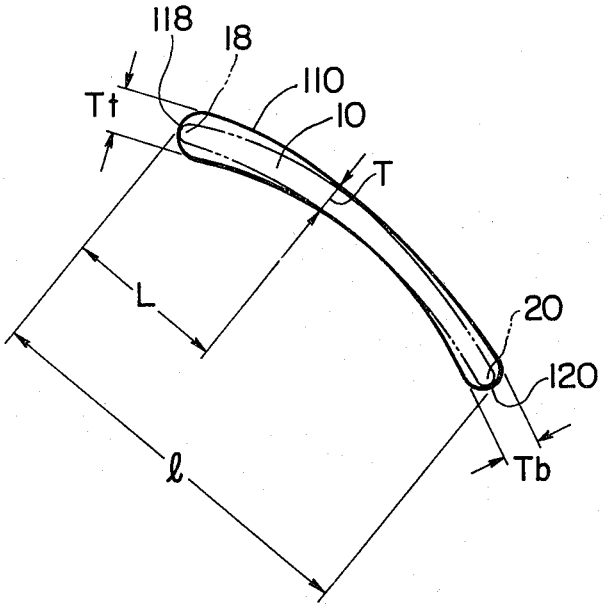
FIG. 3 is a cross section of a fan blade taken along the line A—A in FIG. 4.

In FIG. 3 are shown transverse cross sections respectively of the blades 110 and 10 as being superimposed one on the other for comparing convenience. The transverse cross section through the blade 110 is shown in solid lines as being taken along the line A—A in a limited area region a in FIG. 4 to be described in detail later, while the other transverse cross section shown in the dot and dash lines is also taken along a non-illustrated similar line considerable through the regular blade 10 in FIG. 1. As seen, the blade 110 according to the invention continuously increases in thickness outwardly of a middle point in the transverse cross section whereas the maximum T in thickness of the blade 10 locates intermediately of the leading edge 18 and the trailing edge 20. The location for the maximum in thickness of the blade 10 is selected at a distance L from the leading edge 18 given by multiplying the entire length l of the transverse cross section by 0.4 to 0.6. The reference character T should be noted as referring also to a thickness of a middle point of the blade 110.

Figure 4:
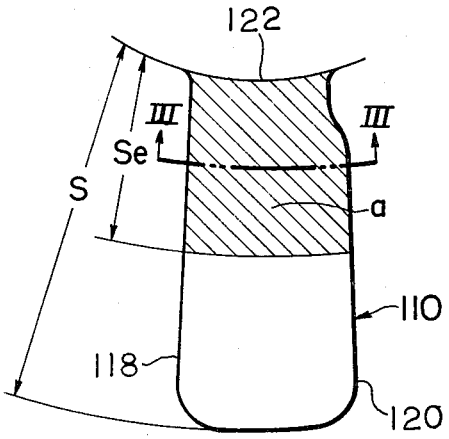
FIG. 4 is a front view of the first embodiment of the invention.

In the first embodiment of the invention in FIG. 4, any transverse cross section through the region a of the blade 110 is contoured under a condition in which a rate of continuous thickness change between the middle point and the leading edge 118 in the transverse cross section is regulated relative to a thickness T of the middle point so that the ratio of a thickness Tf of the leading edge 118 divided by the thickness T of the middle point falls within a range of from 1.0 to 1.5 while another rate of continuous thickness change between the middle point and the trailing edge 120 in the same transverse cross section is regulated relative to the thickness T of the middle point so that the ratio of a thickness Tb of the trailing edge 120 divided by the thickness T of the middle point falls within a range of from 0.7 to 1.2. The middle point is locationally determined as described in the foregoing. The region a radially outwardly neighbors the uppermost edge 122 of the blade 110 and the length Se of the region a is given by multiplying the entire radial length or span S of the blade 110 by 0.2 to 0.6.

The blade obtained as above described has proven to be capable of avoiding substantially the aforementioned concentration of the equal stress lines about the point 116 in the region a (FIG. 4), yet capable of deforming the blade configuration positively in the desire optimum sense at higher operational speeds of the fan.

Figure 5:
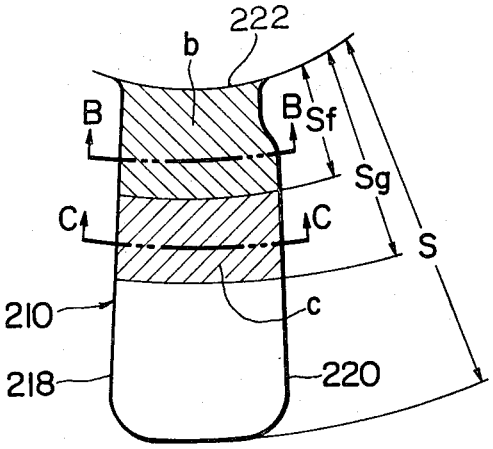
FIG. 5 is a similar view of a second embodiment of the invention.

In FIG. 5 is shown another embodiment of the invention. Any transverse cross section through the region b for example taken along the line B—B is contoured under the same condition as that of the first embodiment in FIG. 4. The region b also neighbors the uppermost edge 222 and extends in a length Sf given by multiplying the span S of the blade 210 by 0.2 to 0.35.

In addition to the above, any transverse cross section through a region c for example taken along the line C—C is contoured also under the same condition as that above described except that there hold the following relations between a thickness Tf' of the leading edge 218, a thickness Tb' of the trailing edge 220, and a thickness T' of a middle point all in the transverse cross section.

$$Tf' = T'(0.8 \text{ to } 1.5)$$

$$Tb' = T'(0.4 \text{ to } 1.0)$$

The region c radially outwardly neighbors the first region b within a reach from the uppermost edge 222 given by multiplying the span S by 0.4 to 0.6. The reach is designated by the reference character Sg.

Since the reference characters Tf', Tb' and T' refer to parts respectively similar to those designated by the reference characters Tf, Tb and T in the foregoing, illustration is considered unnecessary for understanding the transverse cross section through the region c.

What is claimed is:

1. A multiblade fan of plastics comprising:

a central hub and a plurality of blades radially extending from said hub, each blade being flexibly integral with said hub, at least one of said blades having a contour of a transverse cross section through a region neighboring the foot of said blade, said contour of said blade being provided under a condition in which a rate of continuous thickness change between a middle point and the leading edge in said transverse cross section is regulated relative to a thickness T of said middle point so that the ratio of a thickness Tf of said leading edge divided by the thickness T of said middle point falls within a range of from 1.0 to 1.5 while another rate of continuous thickness change between said middle point and the trailing edge in the same transverse cross section is regulated relative to the thickness T of said middle point so that the ratio of a thickness Tb of said trailing edge divided by the thickness T of said middle point falls within a range of from 0.7 to 1.2, said middle point being located in said transverse cross section inwardly from said leading edge at a distance L given by multiplying the entire length l of said transverse cross section by 0.4 to 0.6 wherein, said region of said blade is limited in area so that the following holds, $$Se = S\ (0.2 \text{ to } 0.6)$$

where, Se is a length of said region and S is an entire length of said blade.

2. A multiblade fan of plastics comprising:

a central hub and a plurality of blades radially extending from said hub, each blade being flexibly integral with said hub, at least one of said blades having a contour of a transverse cross section through a region neighboring the foot of said blade, said contour of said blade being provided under a condition in which a rate of continuous thickness change between a middle point and the leading edge in said transverse cross section is regulated relative to a thickness T of said middle point so that the ratio of a thickness Tf of said leading edge divided by the thickness T of said middle point falls within a range of from 1.0 to 1.5 while another rate of continuous thickness change between said middle point and the trailing edge in the same transverse cross section is regulated relative to the thickness T of said middle point so that the ratio of a thickness Tb of said trailing edge divided by the thickness T of said middle point falls within a range of from 0.7 to 1.2, said middle point being located in said transverse cross section inwardly from said leading edge at a distance L given by multiplying the entire length l of said transverse cross section by 0.4 to 0.6 wherein, said region neighboring the foot of said blade is limited in area so that the following holds, $$Sf = S\ (0.2 \text{ to } 3.5)$$

where, Sf is a length of said region and S is the entire length of said blade, said blade having further a second contour of a transverse cross section through a second region radially outwardly neighboring said first region and limited in area so that the following holds, $$Sg = S\ (0.4 \text{ to } 0.6)$$

where, Sg is a length spanning both of said first and second regions, said second contour of said blade being provided under a condition in which a rate of continuous thickness change between a middle point and the leading edge in said transverse cross section is regulated relative to a thickness T′ of said middle point so that the ratio of a thickness Tf′ of said leading edge divided by the thickness T′ of said middle point falls within a range of from 0.8 to 1.5 while another rate of continuous thickness change between said middle point and the trailing edge in the same transverse cross section is regulated relative to the thickness T′ of said middle point so that the ratio of a thickness Tb′ of said trailing edge divided by the thickness T′ of said middle point falls within a range of from 0.4 to 1.0.

* * * * *